US006435905B1

(12) United States Patent
Yu et al.

(10) Patent No.: US 6,435,905 B1
(45) Date of Patent: Aug. 20, 2002

(54) COMPACT ELECTRICAL CONNECTOR HAVING BOARDLOCKS

(75) Inventors: Weicheng Yu; GuangXing Shi; Weiya Cheng; Qiang Chen, all of Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/879,277

(22) Filed: Jun. 11, 2001

(30) Foreign Application Priority Data

Dec. 21, 2000 (TW) ..... 89222266 U

(51) Int. Cl.[7] ..... H81R 13/73
(52) U.S. Cl. ..... 439/567
(58) Field of Search ..... 439/567, 571, 439/572

(56) References Cited

U.S. PATENT DOCUMENTS 6,086,418 A * 7/2000 Chang ..... 439/567
6,210,220 B1 * 4/2001 Zhu et al. ..... 439/567
6,217,378 B1 * 4/2001 Wu ..... 439/567

* cited by examiner

*Primary Examiner*—Gary F. Paumen
(74) *Attorney, Agent, or Firm*—Wei Te Chung

(57) ABSTRACT

An electrical connector (100) including a housing (1), a number of terminals (2), a pair of metallic boardlocks (4), and a conductive shield (3). The housing has a base wall (12) that defines at each of opposite ends thereof a recess (121) and a pair of cutouts (123) located symmetrically in a front surface and a bottom surface thereof, and a mating wall (11). Each cutout surrounds a projection (122). Each boardlock consists of a body (44), a head (42) projecting upwardly from the body and seated in a corresponding recess, a pair of arms (45) projecting from the body and locking to the projections, and a pair of feet (43). The shield has a pair of fingers (33) extending across the heads for fitting the boardlocks to the base wall and establishing a grounding path therethrough. The width of the connector is minimized to substantially as that of the mating wall.

1 Claim, 5 Drawing Sheets

COMPACT ELECTRICAL CONNECTOR HAVING BOARDLOCKS

CROSS-REFERENCES TO RELATED APPLICATIONS

This application is related to a copending U.S. patent application Ser. No. 09/877,577 filed on Jun. 8, 2001 and titled "Compact Electrical Connector Having Boardlocks" by the same inventors and assigned to the same assignee of the present application.

BACKGROUND OF THE INVENTION

1. Field of the Invention

The present invention relates to an electrical connector and particularly to an electrical connector having a minimized lateral dimension and having a pair of boardlocks reliably secured thereon.

2. Description of Related Art

As is shown in FIG. 1, a conventional connector 7 includes a dielectric housing 70, a plurality of terminals 71 secured in the housing 70, a pair of boardlocks 78 mounted on the housing 70, and a metal shield 72 attached to the housing 70.

The housing 70 has a mating wall 701 in which the terminals 71 are received and forms a pair of blocks 702 at opposite lateral ends thereof. The shield 72 surrounds the mating wall 701. Each boardlock 78 is secured in a corresponding block 702 such that a finger 781 thereof extends inwardly toward the mating wall 701 and abuts against the shield 72 for establishing an electrical path therebetween. By such design, the blocks 702 are situated in line with the mating wall 701 and thus require the housing 70 to be significantly wider than the mating wall 701. However, minimization is a trend in computer industry, which prefers compact connectors. The conventional connector can hardly satisfy the minimization requirement since it needs a pair of blocks 702 projecting outwardly beside the mating wall 701 to receive the boardlocks 78. It is thus desired to omit the blocks and provide a connector possessing a width substantially equal to that of the mating wall.

SUMMARY OF THE INVENTION

Accordingly, one object of the present invention is to provide a compact electrical connector with minimized lateral dimension.

Another object of the present invention is to provide an electrical connector having a pair of boardlocks reliably secured on lateral sides of a housing thereof without increasing width of the housing.

In order to achieve the objects set forth, an electrical connector comprises a dielectric housing, a pair of metallic boardlocks mounted to the housing, and a shield attached to the housing.

The housing includes a base wall, a mating wall projecting forwardly from the base wall for mating with a complementary connector, and a pair of platforms. The base wall defines a recess in each of two opposite outer surfaces thereof. Two sets of C-shaped cutouts are located respectively in a front surface and a rear surface of the base wall in positions below the mating wall and above the platforms. Furthermore, each C-shaped cutout surrounds a rectangular projection.

Each boardlock has a flat head, a body, a pair of arms, and a pair of feet depending from the body for catching a printed circuit board on which the connector is mounted. Each arm is C-shaped and extends perpendicularly from lateral sides of the feet. Alternatively, the C-shaped arms may be altered to be P-shaped and connect with the feet at one juncture. The boardlocks are fixed to the housing such that the heads are seated in the recesses of the base wall and the arms are accommodated in corresponding cutouts of the base wall. The arms are locked to the projections and thus attach the boardlocks to lateral sides of he base wall.

In addition, the shield provides a pair of rearwardly extending fingers which extend across the heads and grip the bottom surface of the base wall. The fingers abut the heads of the boardlocks against the base wall of the housing and electrically connect with the boardlocks for grounding.

It is a feature of the present invention that the heads seated in the recesses are flush with the outer surfaces of the base wall and outer surfaces of the fingers of the shield are flush with the feet extending over the outer surfaces of the base wall. The width of connector is thus minimized as to substantially equal to the width of the mating wall.

Other objects, advantages and novel features of the invention will become more apparent from the following detailed description when taken in conjunction with the accompanying drawings.

DETAILED DESCRIPTION OF THE INVENTION

Figure 1:
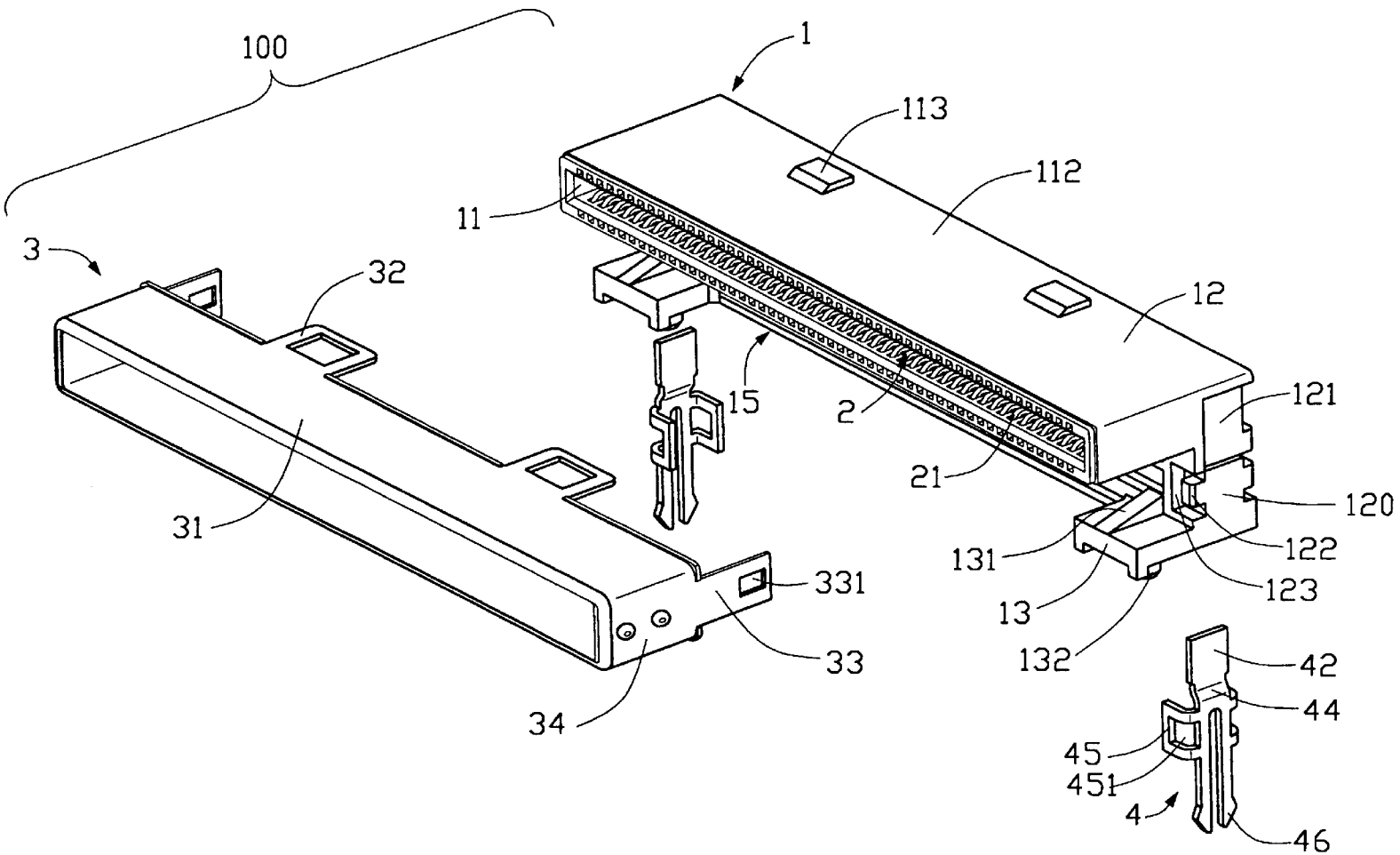
FIG. 1 is a partially exploded view of an electrical connector, showing a pair of boardlocks in accordance with a first embodiment of the present invention.

Referring to FIG. 1, an electrical connector 100 of the present invention comprises an insulative housing 1, a plurality of metal terminals 2 received in the insulative housing 1, a pair of metallic boardlocks 4, and a conductive shield 3 for binding the insulative housing 1 and the boardlocks 4 together.

The insulative housing 1 includes a longitudinal base wall 12, a mating wall 11 projecting forwardly from an upper portion of the base wall 12, and a pair of platforms 13 extending forwardly from a lower portion of the base wall 12. The mating wall 11 and the base wall 12 are of same width. The feet 13 are vertically spaced from the mating wall 12, defining a space 15 therebetween in front of the base wall 12.

The base wall 12 defines in opposite ends thereof a pair of flat recesses 121 and a pair of C-shaped cutouts 123 aligning in a direction perpendicular to the base wall 12. Each pair of the cutouts 123 is symmetrically located in a rear surface 126 and a front surface 127 of the base wall 12 and is located below the mating wall 11 and above a corresponding platform 13. The cutouts 123 extend inwardly from outer surfaces 120 of the base wall 12 below the recesses 121 and each surround a projection 122. The projections 122 each have a side flush with the outer surface 120. Moreover, the base wall 12 forms a pair of protrusions 113 on a top surface 112 thereof for locking the shield 3 on the housing 1.

The mating wall 11 is box-like and its width is equal to that of the base wall 12. The mating wall 11 defines an engaging opening 11 extending rearwardly from a front surface thereof and within which engaging sections 21 of the terminals 2 protrude for mating with corresponding engaging portions of a complementary connector (not shown).

Each platform 13 forms a retaining block 131 in the space 15 on a top surface thereof. The retaining blocks 131 are respectively connected to the front surface 127 of the base wall 12 at portions inward from corresponding cutouts 123. The platforms 13 each provide a post 132 on a bottom surface thereof for positioning the connector 100 relative to a printed circuit board (not shown) on which the connector 100 is mounted.

Each boardlock 4 has a flat head 42, a body 44 connecting with the head 42, a pair of arms 45, and a pair of feet 46 depending from the body 44 for resiliently catching the printed circuit board (not shown) on which the connector 100 is mounted. The body 44 is step-shaped such that the head 42 and the feet 46 are parallel to each other. Each arm 45 is C-shaped and symmetrically and perpendicularly extends from lateral sides of the feet 46 at two junctures. Each arm 45 defines a rectangular hole 451 therethrough. As the feet 46 are bifurcated and are deflectable, the arms 45 can accommodate the tolerance and tightly abut against the projections 122 for locking the boardlocks 4 to the base wall 12.

The shield includes a shroud 31, a pair of locking members 32 projecting rearwardly from a top edge of the shroud 31, and a pair of finger 33 extending rearwardly from lateral edges 34 of the shroud 31. Each finger 33 defines an opening 331 at a rear end thereof which benefits the finger 33 to be folded.

Figure 2:
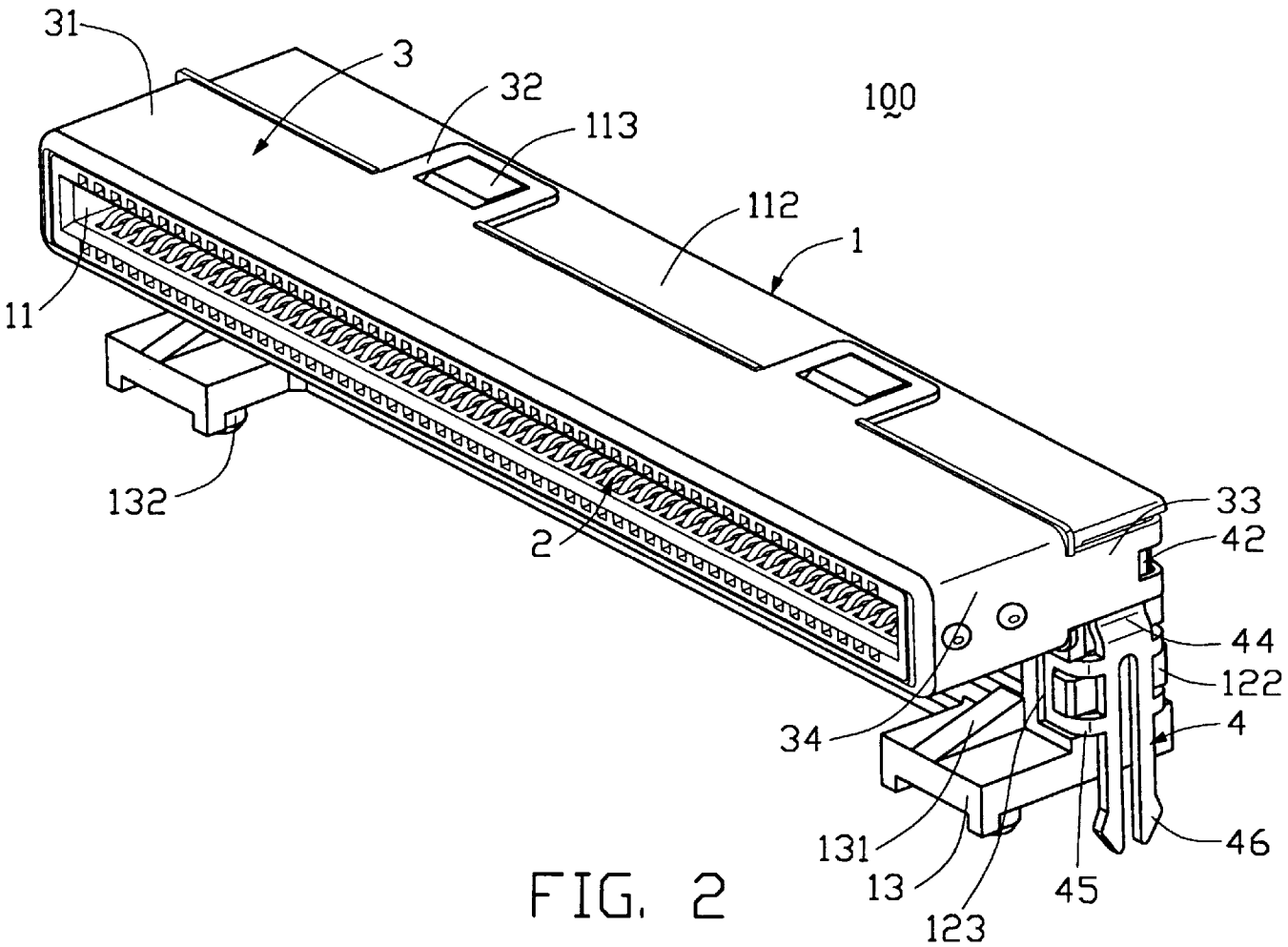
FIG. 2 is an assembled view of the electrical connector of FIG. 1.
Figure 3:
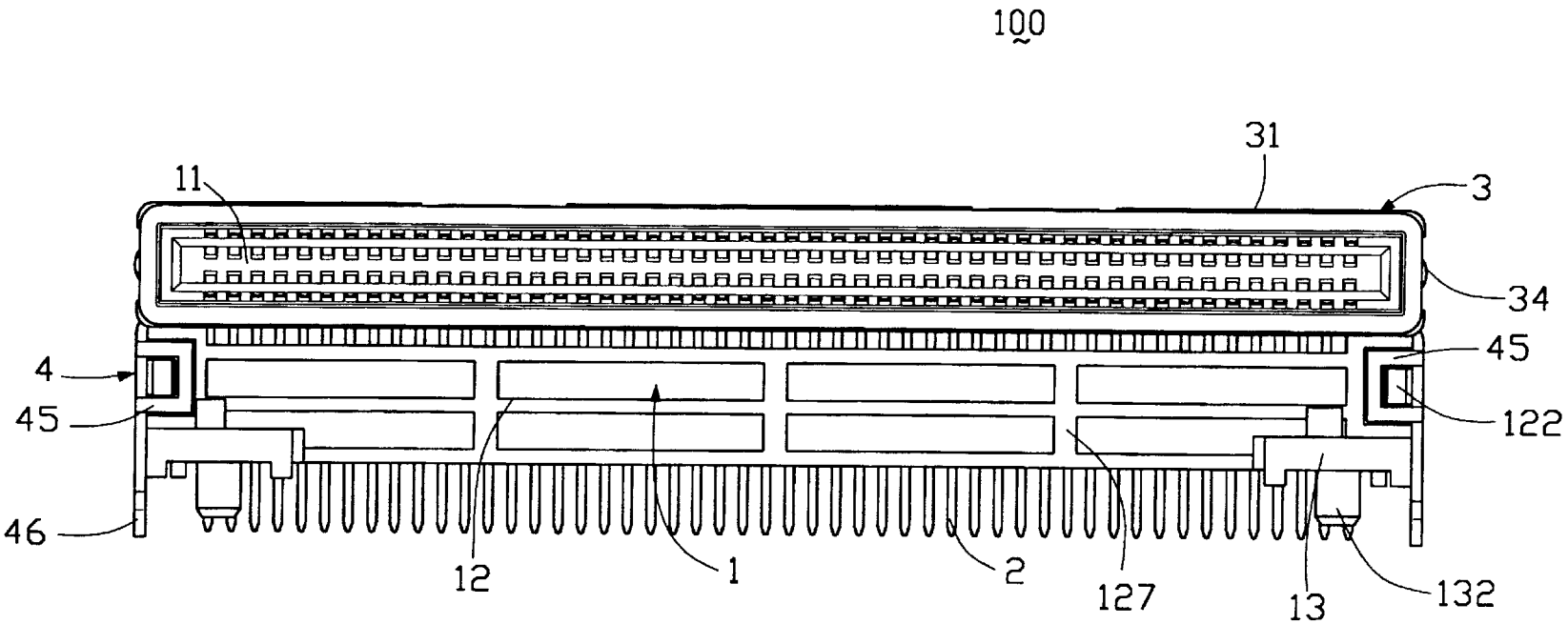
FIG. 3 is a front view of the electrical connector of FIG. 2.

In assembly, as is shown in FIGS. 2 and 3, the boardlocks 4 are firstly attached to the base wall 12 of the housing 1 in a way that the heads 42 are seated in the recesses 121, the feet 43 extend over the outer surface 120, and the arms 45 are bent into corresponding cutouts 123 of the base wall 12. The head 42 has a side abutting against the base wall 12 and an opposite side flush with the outer surface 120. The pair of arms 45 received in the cutouts 123 is located below the mating wall 11 and clamps the base wall 12 therebetween so as to avoid the boardlocks 4 from any movement relative to the base wall 12. Meanwhile, the arms 45 are locked to the base wall 12 in a way that the projections 122 of the base wall 12 extend through the holes 451 of the arms 45. The projections 122 abut against the arms 45 and prevent the arms 45 from falling from the base wall 12.

Secondly, the shield 3 is finally assembled to the housing 1. The shroud 31 surrounds the mating wall 11. The locking members 32 are stopped by the protrusions 113 while the fingers 33 extend rearwardly beyond the base wall 12 and are bent to the rear surface 126 of the base wall 12, the locking members 32 and the fingers 33 together attaching the shield 3 to the housing 1. The fingers 33 extend across the heads 42 and press the heads 42 against the base wall 12, thereby securing the boardlocks 4 on the housing 1. Since the heads 42 are flush with the outer surfaces 120 on which the feet 43 abut and the thickness of the fingers 33 is substantially equal to that of the feet 43, lateral sides 34 of the shield 3 are substantially planar with outer sides of the feet 43 of the boardlocks 4. Therefore, the width of the connector 100 is minimized to substantially equal to the sum of the width of the mating opening 1, the thickness of a sidewall of the mating wall 11, and the thickness of the finger 33 of the shield 3. In other words, the width of the connector 100 is substantially the width of the shroud 31 of the shield 3.

Figure 4:
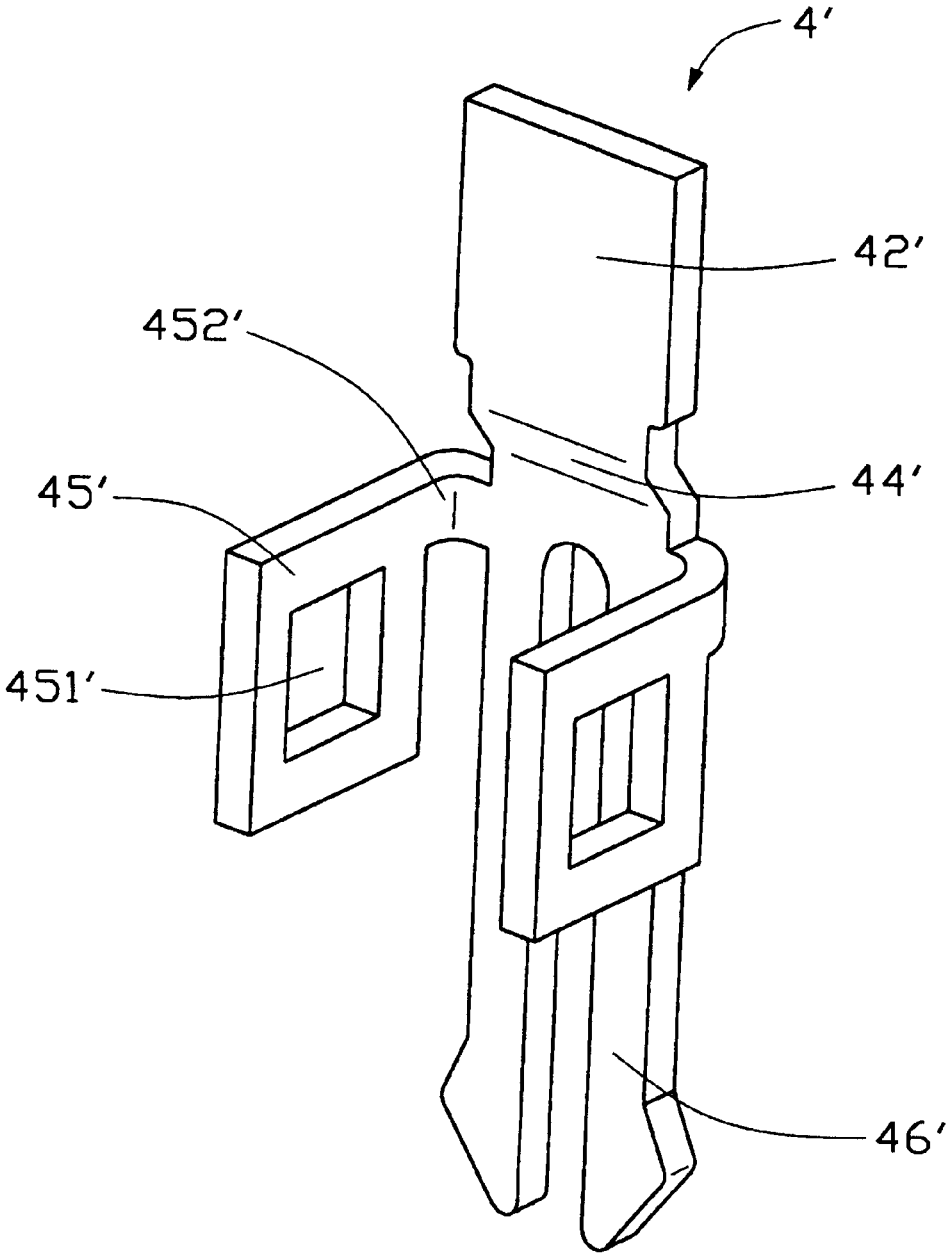
FIG. 4 is a perspective view of a boardlock in accordance with a second embodiment of the present invention.
Figure 5:
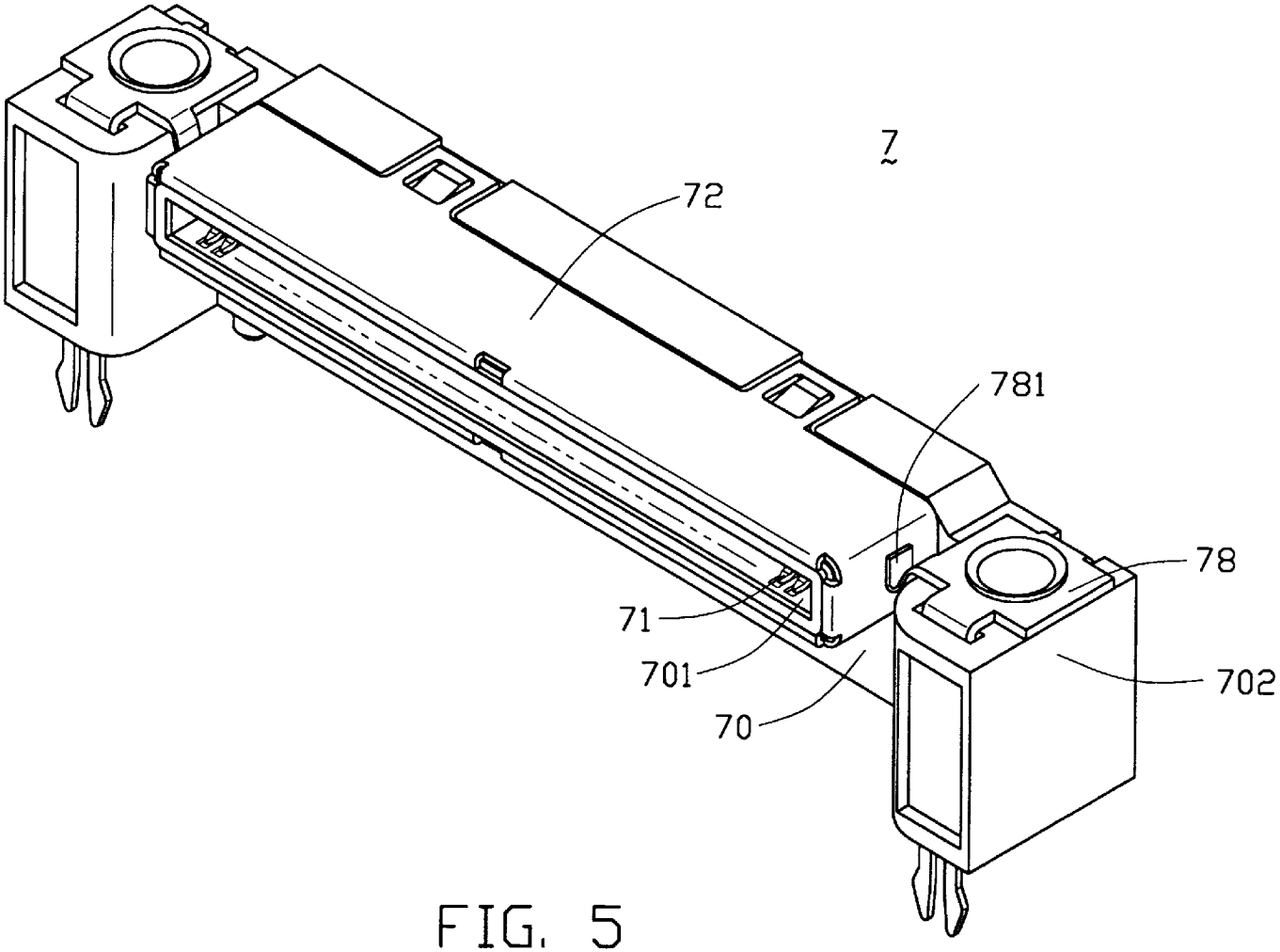
FIG. 5 (PRIOR ART)
FIG. 5 is a perspective view of a conventional connector.

In a second embodiment of the present invention, the electrical connector 100 has a pair of boardlocks 45', one of which is shown in FIG. 4. Each boardlock 4' is similar to the boardlock 4 and has a head 42', a body 44', a pair of arms 45', and a pair of feet 46'. Unlike the arms 45 of the boardlock 4, the arms 45' of the boardlock 4' are P-shaped. Each arm 45' defines a rectangular hole 451' and a bridge 452' connected to one of lateral sides of the feet 46'.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector for mounting on a printed circuit board, comprising:

an insulative housing including a base wall and a mating wall projecting forwardly from the base wall for mating with a complementary connector, the base wall defining in a lateral side thereof a recess and a pair of cutouts and forming a pair of projections surrounded by the cutouts;

a plurality of terminals mounted in the mating wall for engaging with corresponding contacts of the complementary connector;

a metallic boardlock attached to the base wall of the housing, the boardlock having a head seated in the recess, a tail member depending beyond the base wall for extending into the printed circuit board, and a pair of arms locked to the projections for fixing the boardlock to the housing; and a metallic shield having a shroud surrounding the mating wall and a finger abutting the head of the boardlock against the lateral side of the base wall and clinging to the base wall of the housing;

wherein the projections are respectively provided on opposite sides of the lateral side of the base wall;

wherein the head has one side abutting against the recess of the base wall and an opposite side flush with an outer surface of the lateral side of the base wall;

wherein the arms each extend perpendicularly from lateral sides of the tail member and define a hole through which corresponding projection extends;

wherein the arms are seated in the cutouts and are oriented in a direction parallel to the outer surface;

wherein the projections and the cutouts are located below the mating wall;

wherein the head and the tail member are parallel to each other;

wherein each of the arms joins the tail member at two junctures and cooperates with the tail member to define the hole;

further comprising a pair of platforms under the mating wall, each platform forming a retaining block on an upper surface thereof connected with a front surface of the base wall;

wherein one of the projections is formed below the mating wall and above the platform and is located outwardly of the retaining blocks;

wherein the base wall forms a pair of protrusions on an upper surface thereof and the shroud of the shield forms a pair of locking members at an upper edge thereof, the locking members extending rearwardly and latching to the protrusions.

* * * * *